US007458135B2

(12) United States Patent
Mikesell et al.

(10) Patent No.: US 7,458,135 B2
(45) Date of Patent: Dec. 2, 2008

(54) TETHER

(75) Inventors: Kenneth W. Mikesell, Arvada, CO (US); Michael J. Bible, Fort Collins, CO (US)

(73) Assignee: Castle Mountain Enterprises, LLC, Arvada, CO (US)

( * ) Notice: Subject to any disclaimer, the term of this patent is extended or adjusted under 35 U.S.C. 154(b) by 55 days.

(21) Appl. No.: 11/492,629

(22) Filed: Jul. 25, 2006

(65) Prior Publication Data

US 2007/0145087 A1 Jun. 28, 2007

Related U.S. Application Data

(63) Continuation-in-part of application No. 11/414,603, filed on Apr. 28, 2006.

(60) Provisional application No. 60/738,479, filed on Nov. 21, 2005.

(51) Int. Cl.

| | |
|---|---|
| ***A45C 13/30*** | (2006.01) |
| ***A45F 3/14*** | (2006.01) |
| ***A45F 5/00*** | (2006.01) |

(52) U.S. Cl. ..... 24/300; 24/301

(58) Field of Classification Search ..... 24/300, 24/301

See application file for complete search history.

(56) References Cited

U.S. PATENT DOCUMENTS

| | | | | |
|---|---|---|---|---|
| 1,401,227 | A * | 12/1921 | Wyeth | 2/323 |
| 4,653,422 | A * | 3/1987 | Allen | 116/28 R |
| 5,402,557 | A * | 4/1995 | Dalen | 24/68 CD |
| 5,611,119 | A * | 3/1997 | Allen | 24/301 |
| 6,014,794 | A * | 1/2000 | Mc Coy | 24/300 |
| 6,202,263 | B1 | 3/2001 | Harker | |
| 6,389,655 | B2 * | 5/2002 | Libecco | 24/300 |

OTHER PUBLICATIONS

Yea JWU Plastics Enterprise Co., Ltd.; TPU elastic strap; downloaded: Jul. 11, 2006; pp. 1-2; http://www.manufacturers.com.tw/showroom-1506-4-5-0000015180-0.php Copyright 2006, G.T. Internet Information Co., Ltd.

* cited by examiner

*Primary Examiner*—Robert J Sandy
(74) *Attorney, Agent, or Firm*—Craig Miles; CR Miles, P.C.

(57) ABSTRACT

A tether having an elastic member which provides an unstretched length having a first part and a second part with the first part of the unstretched length having less elastic resistance than a second part of the unstretched length to alter characteristics of stretch and recovery toward the unstretched length under load and unloaded conditions.

19 Claims, 9 Drawing Sheets

TETHER

This United States Patent Application is a continuation-in-part of U.S. patent application Ser. No. 11/414,603, filed Apr. 28, 2006, and claims the benefit of U.S. Provisional Patent Application No. 60/738,479, filed Nov. 21, 2005, hereby incorporated by reference herein.

I. BACKGROUND

A tether having an elastic member which provides an unstretched length having a first part and a second part with the first part of the unstretched length having less elastic resistance than a second part of the unstretched length to alter characteristics of stretch and recovery toward the unstretched length under load.

Conventional tethers, leashes, or other devices coupled between a pair of objects to limit the range of travel of a first of the pair of objects relative to the second of the pair of objects (hereinafter "conventional tether") have either no elastic member or an elastic member having substantially homogeneous stretch and recovery characteristics along the entire length (hereinafter "conventional elastic member").

Conventional tethers which utilize a conventional elastic member having substantially homogeneous stretch and recovery characteristics along the entire length have a limited range of responses to a load as it is applied to and removed from the conventional tether. This can be problematic in the context in which a first end of the conventional tether is coupled to a falling object (or otherwise traveling object) and the second end of the conventional tether has a fixed or substantially fixed location. As the conventional elastic member stretches in response to the load generated by the falling (or traveling) object, the rate at which the falling object decelerates may be too little or too great over a given distance. At the first extreme where the conventional tether has little or no elastic characteristic the rate of deceleration can be very great resulting in transmission of the entire force of deceleration to the second end of the conventional tether over a correspondingly short amount of time. At the other extreme where the conventional tether has a great amount of elastic character, the rate of deceleration can be low with the forces of deceleration stored in the conventional elastic member as it stretches. In this case, upon recovery of the conventional elastic member toward the original unstretched length, the conventional elastic member can generate an undesired amount of travel in the attached object in the opposite direction in which it fell or traveled. Because there are a limited number of elastic materials which can be utilized as conventional elastic members of conventional tethers it can be difficult to generate the proper elastic characteristics in a conventional tether for certain applications. The conventional tether, therefore, can afford conventional elastic characteristics which can be either too little or too great for a given application.

II. SUMMARY OF THE INVENTION

Accordingly, a broad object of the invention can be to provide a tether having an elastic member which provides at least a first part and a second part with the first part having less elastic resistance than a second part to alter characteristics of stretch and recovery of the tether under load.

A second broad object of the invention can be to provide a tether having an elastic member which provides at least a first part and a second part with the first part having less elastic resistance than in combination with the second part to alter characteristics of stretch and recovery of the tether under load.

A third broad object of the invention can be to provide a tether which provides an unstretched length having a first part and a second part with the first part of the unstretched length having less elastic resistance than the elastic resistance of a second part of the unstretched length to alter characteristics of stretch and recovery of the unstretched length under load.

Naturally, further objects of the invention are disclosed throughout other areas of the specification, drawings, photographs, and claims.

III. A BRIEF DESCRIPTION OF THE DRAWINGS

IV. DETAILED DESCRIPTION OF THE PREFERRED EMBODIMENTS

A tether having an elastic member which provides an unstretched length having a first part and a second part with the first part of the unstretched length having less elastic resistance than a second part of the unstretched length to alter characteristics of stretch and recovery toward the unstretched length under load.

Figure 1:
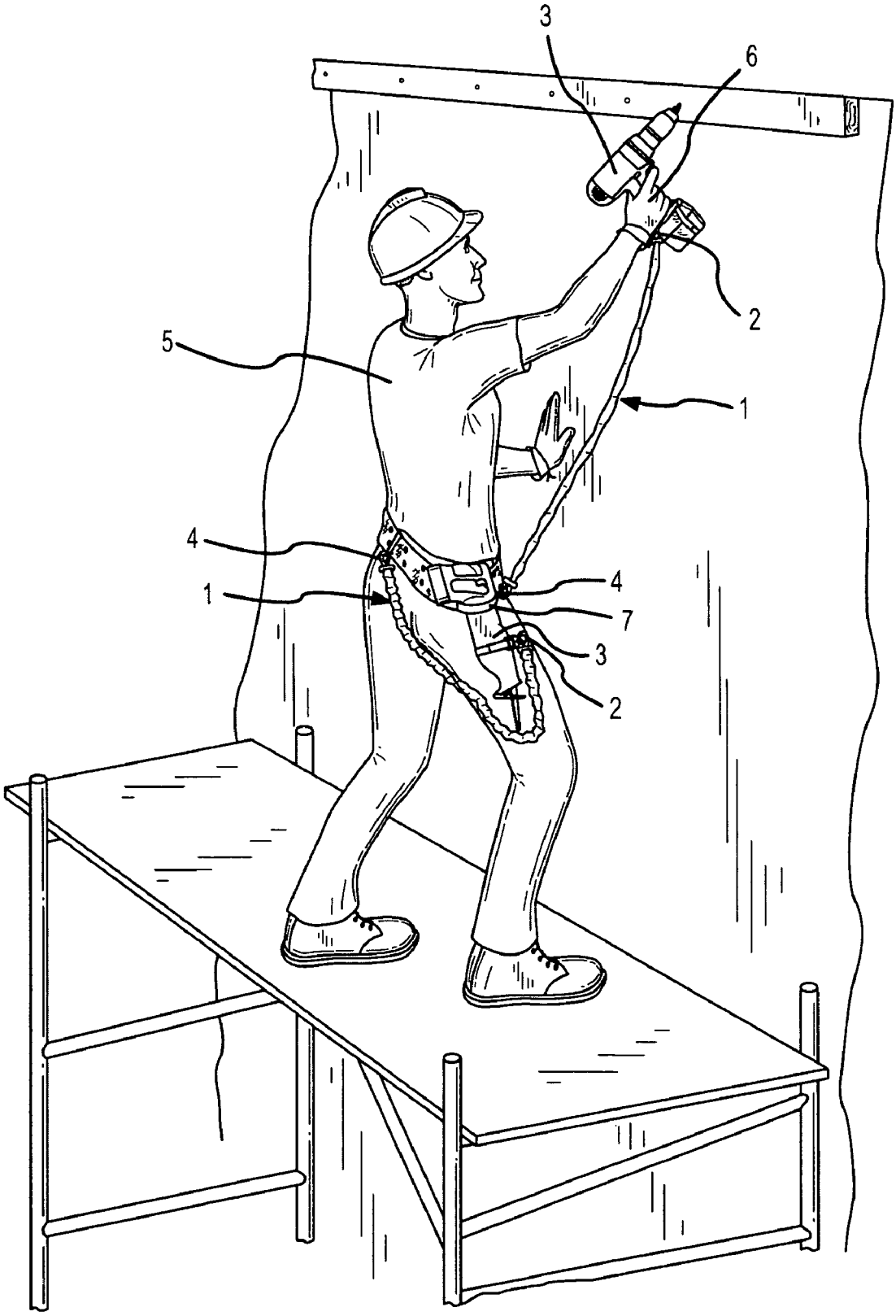
FIG. 1 is an illustration showing a method of using the inventive tether.
Figure 2:
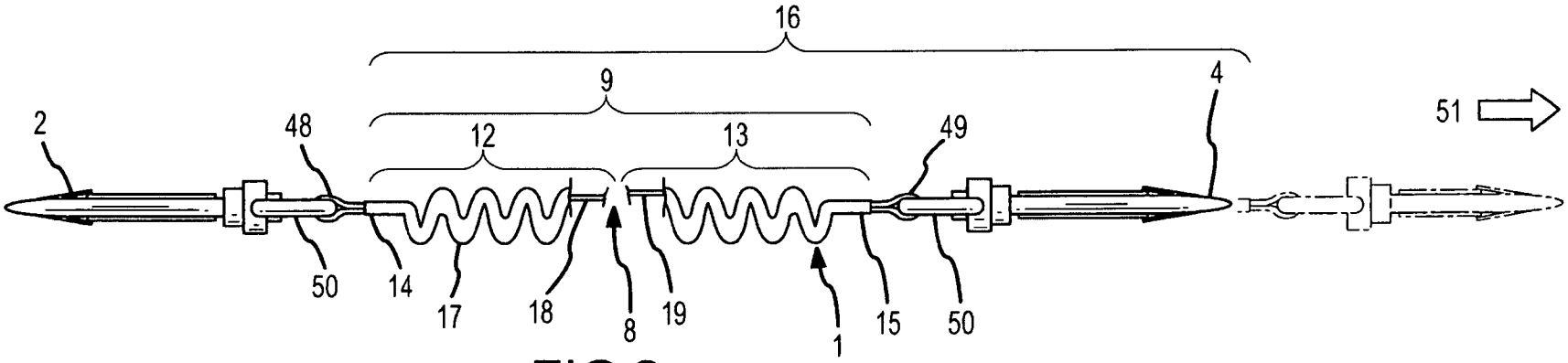
FIG. 2 is side view of a particular embodiment of the inventive tether.
Figure 3:
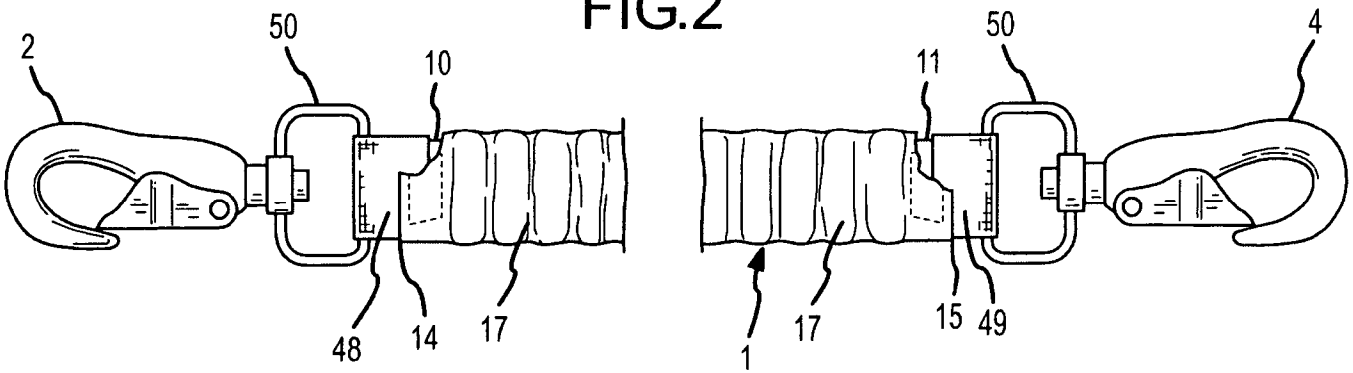
FIG. 3 is a front view of a particular embodiment of the inventive tether.
Figure 4:
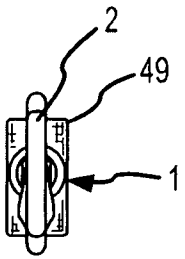
FIG. 4 is an end view of a particular embodiment of the inventive tether.

Now referring primarily to FIG. 1, a particular method of using the inventive tether (1) is shown. The inventive tether (1) can be connected by a first fastener (2) to a tool (3) (or other object) and connected by a second fastener (4) to a person (5)(or a part of a person, the person's clothing, tool belt, or to another object) to establish a limited range of travel for the tool (3)(or other object). As a non-limiting example, if the tool (3) falls from a person's hand (6) or becomes disengaged from a tool restraint (7), or is otherwise urged to travel or falls under the influence of gravity, the distance and travel path of the tool (3) can be limited by the inventive tether (1), or can be anticipated by the person (5) or other persons, thereby reducing the likelihood the tool (3) will cause injury to the person (5) or other person(s) or cause damage to the tool (3) itself or other property.

While FIG. 1 shows a method of using a particular constructional form of the inventive tether (1) which can be connected by a first fastener (2) to a tool (3) and by a second fastener (4) to a person (5), the inventive tether (1) is not so limited, and FIG. 1 along with the description provided hereinabove provides sufficient description from which the person of ordinary skill can use the numerous and wide variety of constructional forms of the inventive tether (1), whether shown by the Figures or particularly described herein, or generated as permutations or combinations of the elements shown or described or equivalents thereof.

The term "tool" as used herein is intended to broadly encompass the numerous and varied devices or objects that a person (5) can utilize in accomplishing a task, whether a hand operated device or coupled to a power source, such as 110 volts alternating current ("VAC"), a battery element, or pressurized gas for pneumatic devices, and includes without limitation saws, drills, sanders, nail guns, or the like, and while FIG. 1 shows a construction worker using a hand held battery powered drill, the term "tool" is not intended to be limited by the occupation of the person (5) or to the particular tool(s) (3) shown by the Figures or as described herein.

Now referring primarily to FIGS. 2-6, basic embodiments of the inventive tether (1) are shown which provide an elastic member (8) having an unstretched length (9) disposed between a first end (10) and a second end (11) (see FIG. 3) which further includes a first portion (12) of the unstretched length (9) which has a first amount of elastic resistance and second portion (13) of the unstretched length (9) which has a second amount of elastic resistance. The term "elastic member" broadly encompasses any member having an unstretched length which stretches due to a load applied to the member and that substantially returns to the unstretched length when the load is removed.

The inventive tether (1) further provides a flexible member (17) disposed between a first end (14) and a second end (15)(see FIG. 2) having less elasticity than the elastic member (8) which limits stretched length (16) of the elastic member (8). A first fastener (2) and a second fastener (4) can be made responsive to a corresponding one of the first end (10) and the second end (11) of the elastic member (8) and to a corresponding one of the first end (14) and the second end (15) of the flexible member (17). As shown by FIGS. 2-6, the first end (10) and the second end (11) of the elastic member (8) and the first end (14) and the second end (15) of the flexible member (17) can be made responsive to the corresponding first fastener (2) and second fastener (4) by joining the ends to a corresponding connector element (48)(49) which in turn engages a part of the corresponding fastener (2)(4)(which in the particular embodiments of the inventive tether (1) shown by FIGS. 2-6 includes a pair of loops to which the corresponding ends (10)(11)(14)(15) are sewn and through which a ring (50) on the corresponding fastener (2)(4) passes). However, the connector element (48)(49) is not intended to be limited in constructional form to a pair of loops and can comprise any constructional form of the first end (10) and the second end (11) of the elastic member (8) or the flexible member (17) (or both) capable of connection to the corresponding fasteners (2)(4) (such as by bonding with an adhesive, engaging a part of each fastener to the surface of the corresponding end of the elastic member (17) or flexible member (8) (for example by rivets), knotting a portion of the elastic member (8) or flexible member about a corresponding part of each fastener (2)(4), or by forming loops in the ends of the elastic member (8) or the flexible member (17) (or both) through which a part of the corresponding fastener (2)(4) passes). Regardless of the constructional form of the connector element (48)(49), the structural relation between the elastic member (8) and the flexible member (17) allows the elastic member (8) to stretch under load an amount limited by the configuration of the flexible member (17) and to substantially return to the unstretched length upon removal of the load (51).

Figure 5:
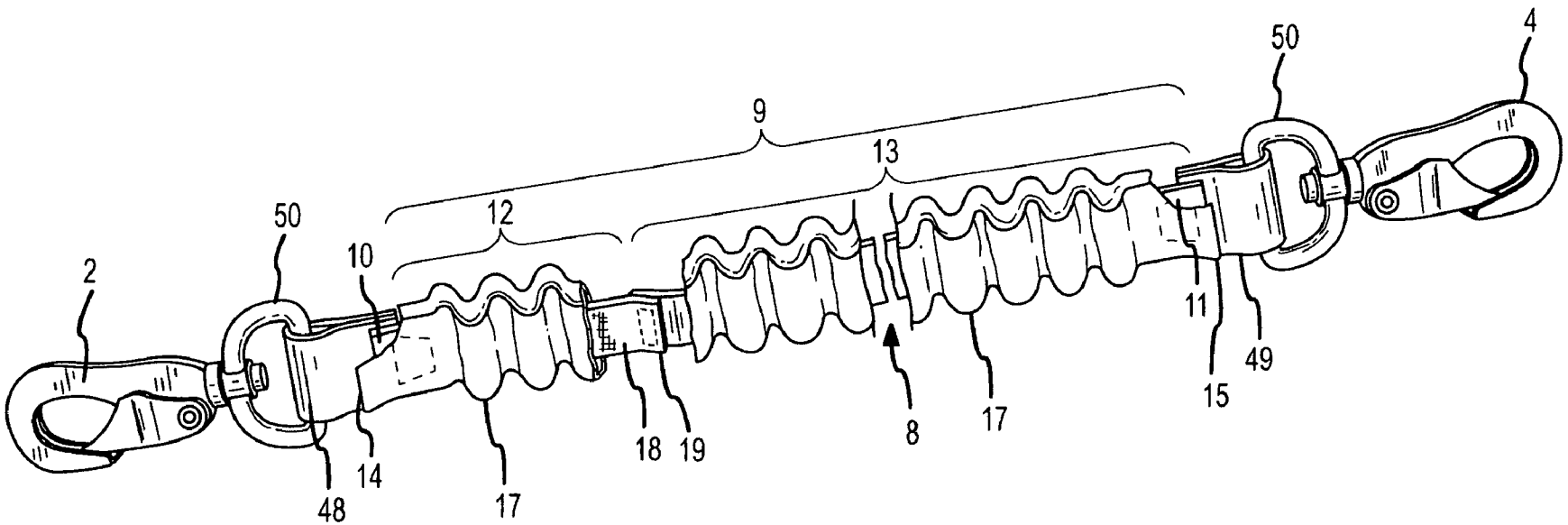
FIG. 5 is a front perspective view of a particular embodiment of the inventive tether.

Now referring specifically to FIG. 5, a particular embodiment of the inventive tether (1) can provide as the first portion (12) of the unstretched length (9) of the elastic member (8) a first discrete elastic element (18) which has a first amount of elastic resistance. The second portion (13) of the unstretched length (9) of the elastic member (8) can comprise a second discrete elastic element (19) which has a second amount of elastic resistance. The first discrete elastic element (18) can be joined to a second discrete elastic element (19) to provide an elastic member (8) having altered stretch characteristics to an applied load. Additional discrete elastic elements having different amounts of elastic resistance can be similarly joined together to provide the elastic member (8) with the necessary or desirable stretch characteristics for a particular application. For example, the elastic member (8) of the inventive tether (1) can have stretch characteristics adjusted or altered to increase deceleration rate of a falling (or traveling) tool coupled to the inventive tether (1) or to have decreased recoil as the elastic member (8) returns to the unstretched length, or both.

Figure 6:
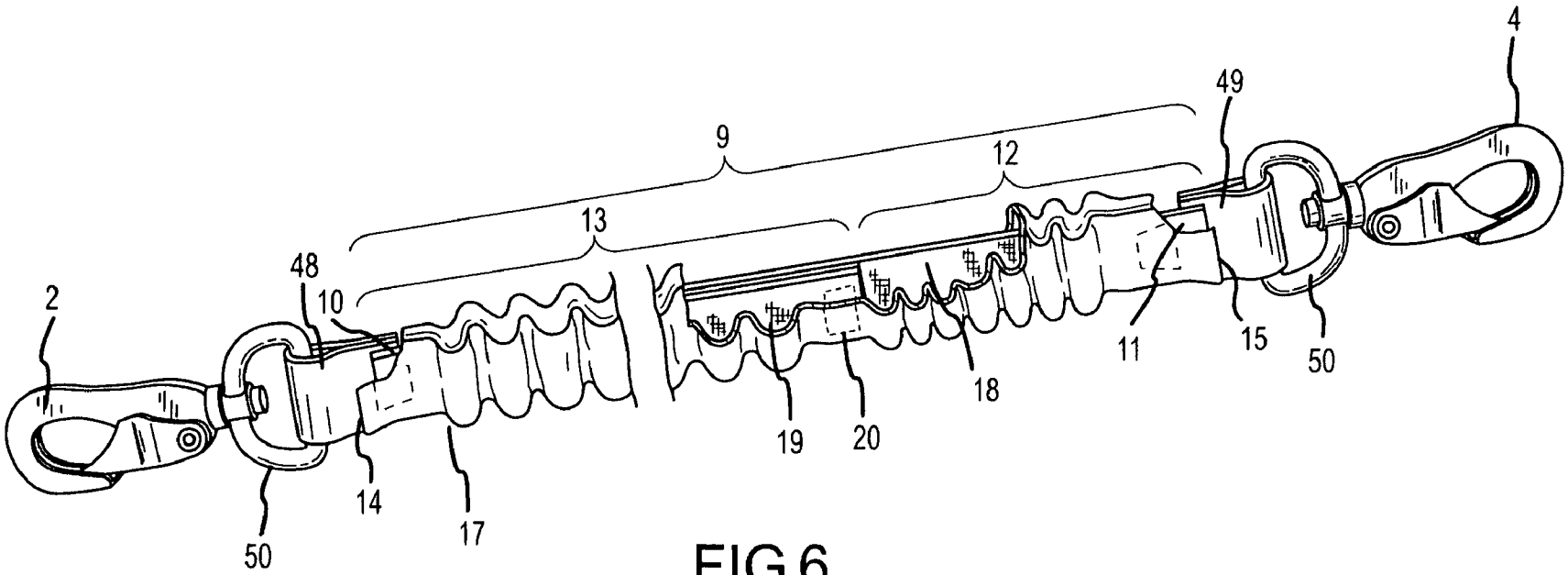
FIG. 6 is a front perspective view of a particular embodiment of the inventive tether.

Now referring specifically to FIG. 6, the first portion (12) of the unstretched length (9) of the elastic member (8) can comprise a first discrete elastic element (18) which has a first amount of elastic resistance. The second portion (13) of the unstretched length of the elastic member (8) can comprise a second discrete elastic element (19) which has a second amount of elastic resistance. The second discrete elastic element (19) can comprise at least two elastic elements the combined amount of elastic resistance comprising the second amount of elastic resistance (the first portion (12) of the unstretched length (9) including the first discrete elastic element (18) having lesser elastic resistance than the second portion (13) of the unstretched length (9) including the second discrete elastic element (19)).

As shown by FIG. 6, particular embodiments of the inventive tether (1) can provide a first discrete elastic element (18) configured as an elastic strap. As to the particular embodiment shown, the elastic strap can have a constructional form having an unstretched length of between about 12 inches-18 inches and a width of about one-half inch to about one inch with a thickness of between about one-thirty second of an inch and about one-sixteenth of an inch. See for example, "TPU Elastic Strap" available from YEA Jwu Plastics Enterprise Co., Ltd., No. 34, Chen-Gong 125 St., Min Shyong Industrial District, Chiayi Hsein, Taiwan, R.O.C., 621.

The second discrete elastic element (19) having at least two elastic elements can be configured as a plurality of layers of the elastic strap, whether the same or different from the elastic strap utilized to provide the first discrete elastic element (18) above-described. The plurality of layers of elastic strap (for example as shown in FIG. 6 as three layers of elastic strap) can be produced from individual pieces of elastic strap laid on top of one another with the ends of the layers held together whether by stitches of a thread (20) as shown by FIG. 6 or otherwise bonded, glued, heat welded, or the like. Or alternately, the at least two elastic elements configured as the plurality of layers of elastic strap can also be produced from a single piece of elastic strap folded upon itself with the ends or folded ends held together as above described.

These particular embodiments of the elastic member (8), the first discrete elastic element (18), the second discrete elastic element (19), or additional discrete elastic elements as above-described are not intended to limit the numerous and varied configurations of elastic elements (or numerous and varied types of elastic strap) or the various compositions or combinations of material from which the elastic member (8), or any elastic element (18)(19) which are encompassed by the inventive tether (1). Rather, any manner of elastic element regardless of composition, combination of material, or configuration is encompassed by the inventive tether limited only by the utility of the elastic element to be utilized as a first portion, a second portion, or additional portion of the elastic member (8).

The term "discrete elastic element" as used herein means that the elastic elements, whether the first or second or additional elastic elements, can be provided as independent elastic elements each having an amount of elastic resistance independent of any other discrete elastic elements and such discrete elastic elements can be joined (whether end to end or by overlapped ends) to provide a first portion (12) and a second portion (13) of the elastic member (8) (or additional parts or portions) with the first portion (12) of the unstretched length (9) having less elastic resistance than a second portion (13) of the unstretched length (9) (and additional portions having greater or lesser elastic resistance) to alter characteristics of stretch and recovery toward the unstretched length (9) of the elastic member (8) under load.

Figure 7:
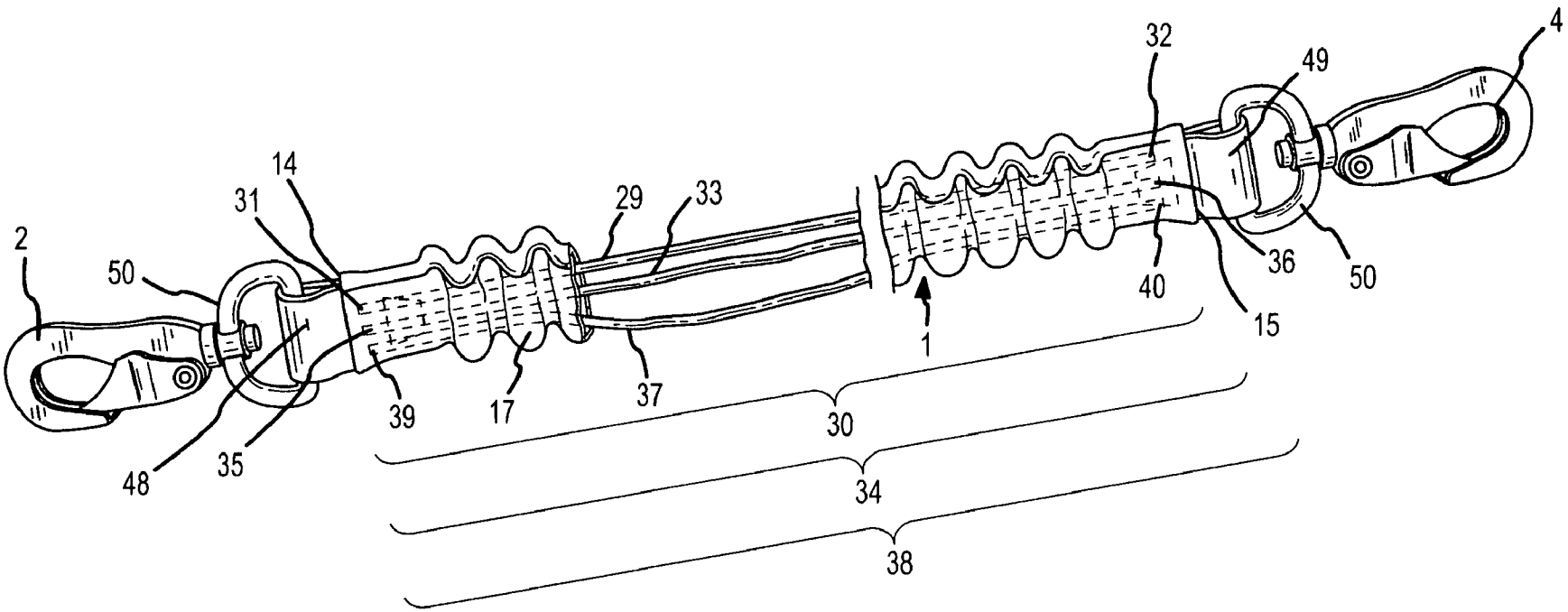
FIG. 7 is a front perspective view of a particular embodiment of the inventive tether.

Now referring to primarily to FIG. 7, another embodiment of the inventive tether (1) can provide a first elastic member (29) having an unstretched length (30) disposed between a first end (31) and a second end (32). The first elastic member (29) can be configured as an elastic cord as shown in the figure or could alternately be configured as an elastic strap as above-described, or otherwise as the invention is not so limited. The inventive tether (1) can further include a second elastic member (33) having a second unstretched length (34) which is greater than the first unstretched length (31) disposed between a first end (35) and a second end (36). Similarly, the inventive tether (1) can further include a third elastic member (37) having a third unstretched length (38) disposed between a first end (39) and a second end (40) which is greater than the first unstretched length (31) or the second unstretched length (34).

As the first elastic member (29) is stretched, a first amount of elastic resistance (resistance to further stretching) can be generated in the first elastic member (29). Once the first elastic member (29) is stretched beyond the second unstretched length (34) of the second elastic member (33), a second amount of elastic resistance associated with further stretching of the second elastic member (33) is combined to the first amount of elastic resistance. Combination of the second amount of elastic resistance of the second elastic member (33) to the first amount of elastic resistance of the first elastic member (29) alters the stretch characteristics of the inventive tether under load and recovery of the inventive tether (1) toward the unstretched length as the load is removed which differentiates the inventive tether (1) from conventional tether devices which may provide a single stretchable member (which may include one or a plurality of stretchable elements) responsive to an applied load. Understandably, by varying the length and the elastic resistance of the first elastic member (29) and the length and the elastic resistance of the second elastic member (33) a wide variation in stretch characteristics can be achieved in the inventive tether (1) to accommodate a correspondingly wide variation in applications in which the inventive tether (1) is utilized.

Similarly, once the second elastic member (33) is stretched beyond the third unstretched length (38) of the third elastic member (37) a third amount of elastic resistance generated by the third elastic member (37) is combined with the first amount of elastic resistance generated by the first elastic member (29) and the second amount of elastic resistance generated by the second elastic member (33) in response to the applied load. Again in similar fashion, additional elastic members can be added to the inventive tether as necessary or desired to accommodate particular applications.

Figure 8:
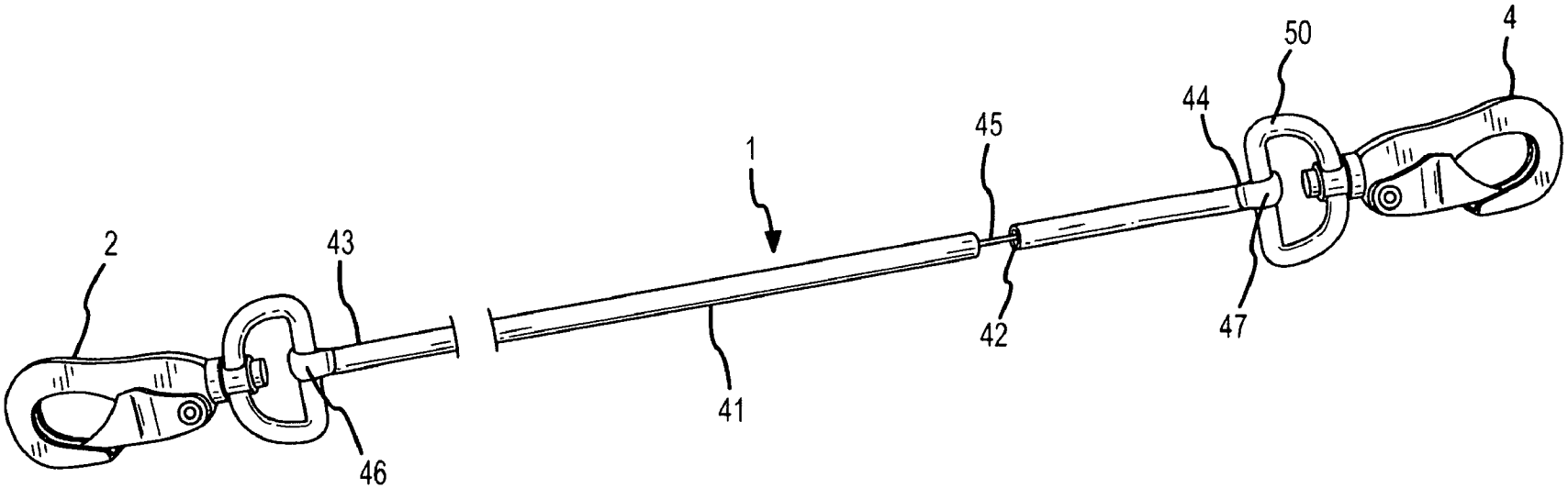
FIG. 8 is a front perspective view of a particular embodiment of the inventive tether.

Now referring primarily to FIG. 8, particular embodiments of the inventive tether can provide an elastic conduit (41) configured to provide a passage (42) in an unstretched length between a first end (43) and a second end (44) and a flexible member (45) having first end (46) and a second end (47) located in the passage (42) of the elastic conduit (41). The first end (43) and the second end (44) of the elastic conduit (41) and the first end (46) and the second end (47) of the flexible member (45) are correspondingly made responsive to a first fastener (2) and a second fastener (4) as above-described as to other embodiments of the inventive tether (1). The flexible member (45) can have less elasticity than the elastic conduit (41) to limit stretch of the elastic conduit (41).

As shown by each of FIGS. 1-8, the first end (10) of the elastic member (8) can be made responsive to a first fastener (2) and the second end (11) of the elastic member (8) can be made responsive to a second fastener (4). While FIG. 5 shows the first fastener (2) and the second fastener (5) as clasp type fasteners, the inventive tether (1) is not so limited and the first fastener (2) and the second fastener (4) can any of a wide and numerous variety of mechanical fasteners such as the clasps, rings, hooks, eyelets, or the like; and the first fastener (2) and the second fastener (4) can be both the same or can be different types of fasteners depending on the application.

Figure 9:
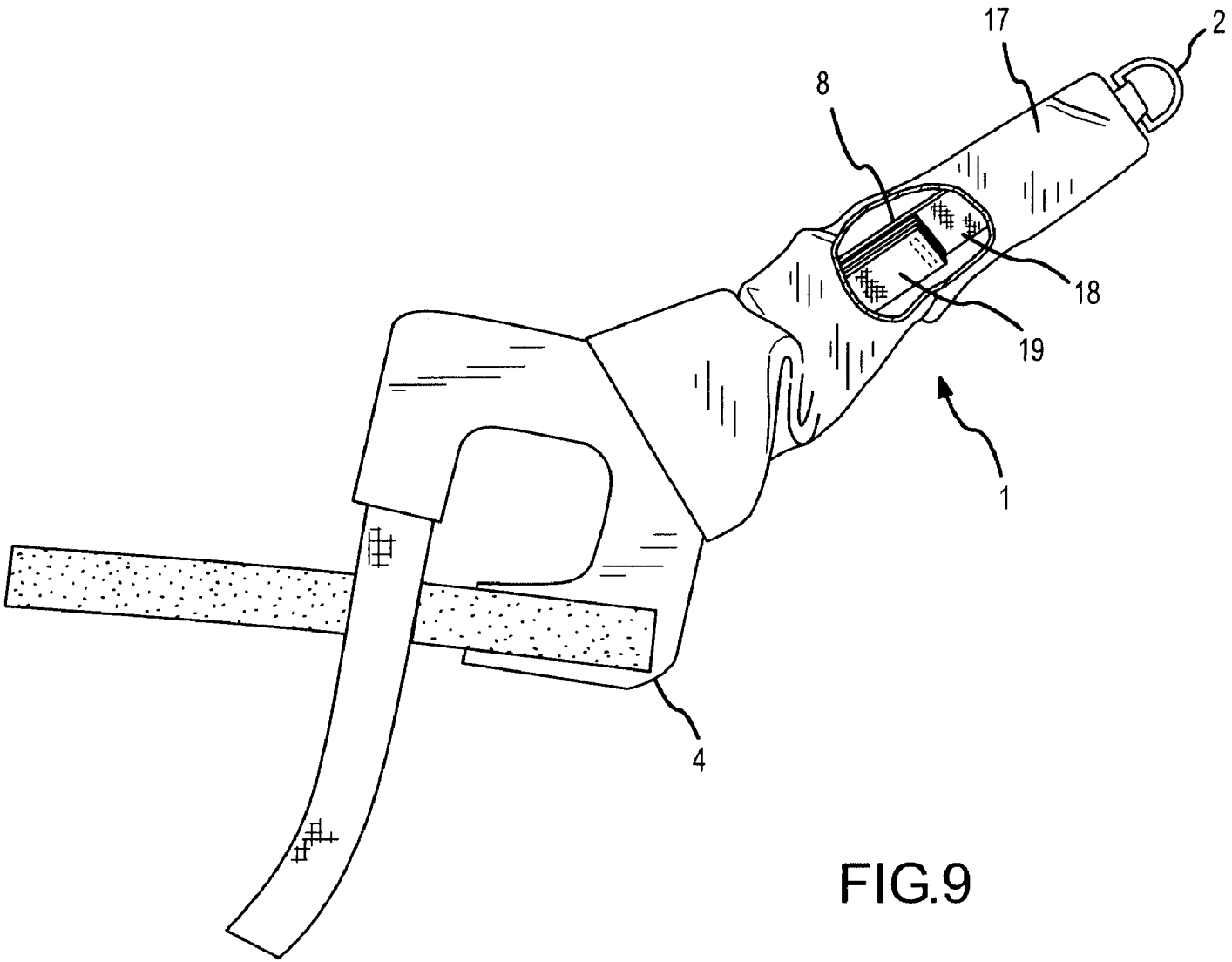
FIG. 9 is a front perspective view of a particular embodiment of the inventive tether.

For example, referring specifically to FIG. 9, the first fastener can be a D-ring (2) and the second fastener (4) can have a constructional form which engages a portion of the external surface of a tool (3) such as wrapping or conforming to a portion of the external surface of a tool (3) to the extent necessary to maintain the tool within the fastener. See for example, U.S. patent application Ser. No. 11/414,603, hereby incorporated by reference herein, which describes various tool containment devices which are configured to wrap about a portion of the external surface of a tool. Also, as shown by FIG. 9 is an alternate embodiment of the flexible member (17) configured as a hollow sleeve through which surrounds the elastic member (8).

Figure 10:
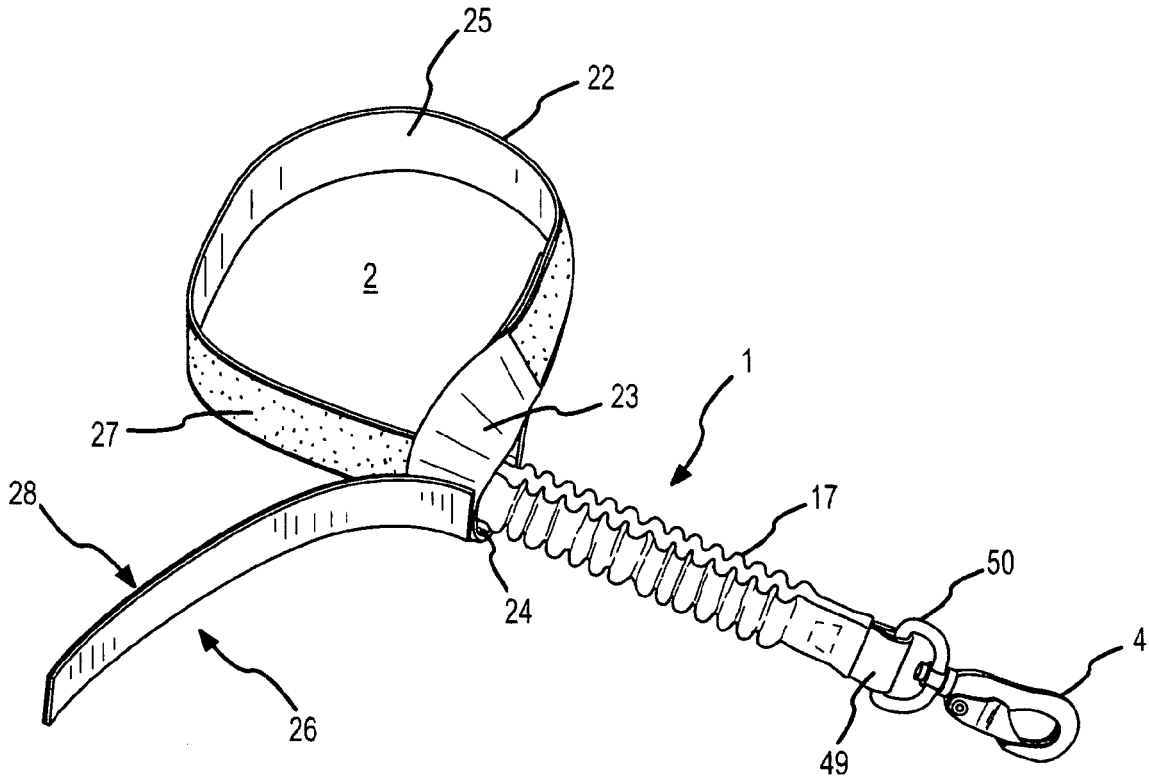
FIG. 10 is a front perspective view of a particular embodiment of the inventive tether.
Figure 11:
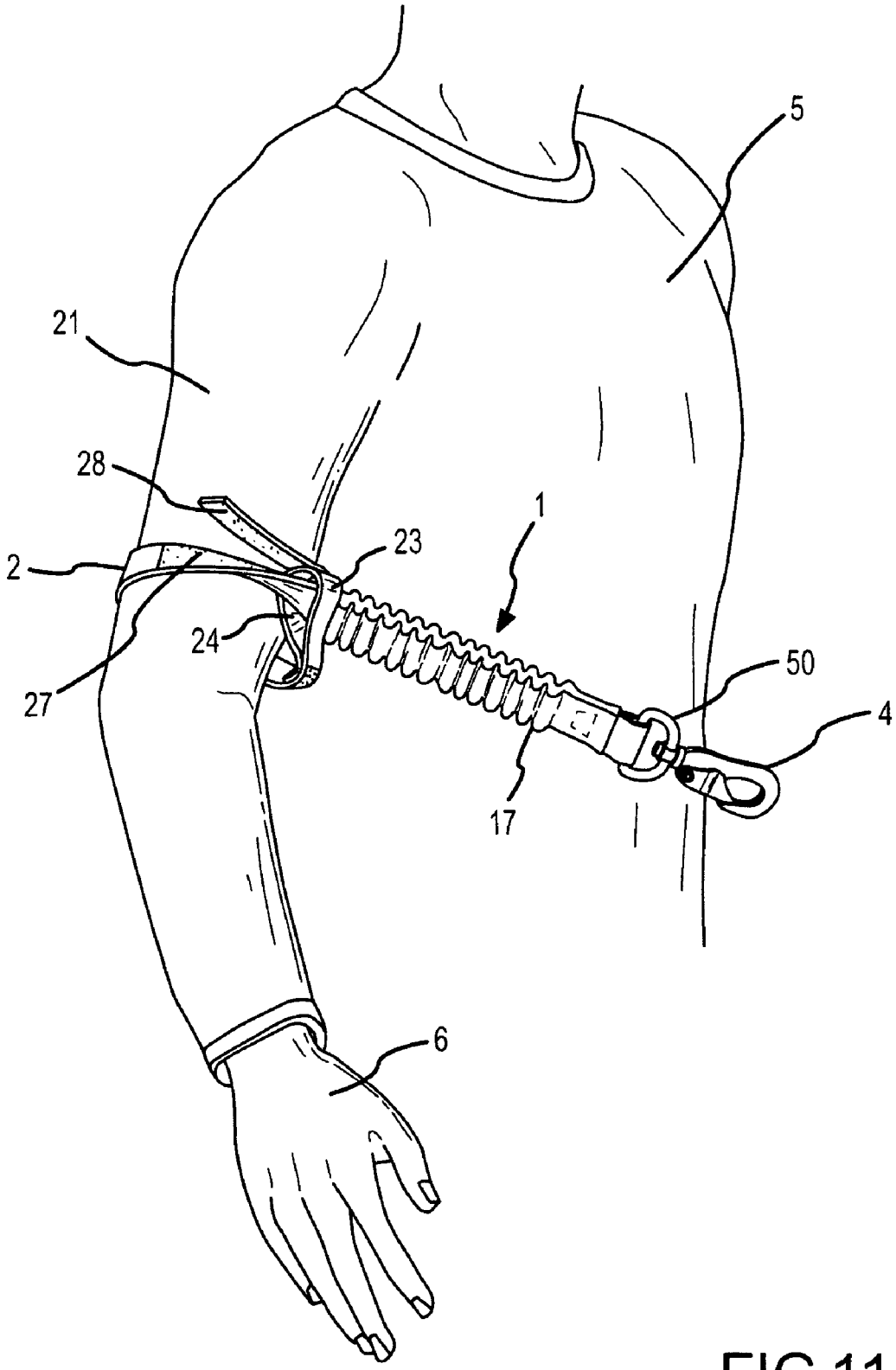
FIG. 11 is an illustration showing a method of using the particular embodiment of the inventive tether shown in FIG. 10.

For example, referring specifically to FIGS. 10 and 11, certain embodiments of the inventive tether (1) can provide as a first fastener (2) an adjustable loop element (22) configured to encircle the upper arm (21) of a person (5) as shown in FIG. 11. The adjustable loop element (22) can be configured as a terminal loop (23) having a loop aperture (24) through which the second fastener (4) and a portion of the tether (1) is drawn to adjustably engage the inside surface (25) of the adjustable loop element (22) with the upper arm (21) (or other part of the person's body depending upon the application). A securement element (26) can provide a pair of mateable parts (27) (28) such as the hook part and the loop part of VELCRO® which can be engaged to secure the adjustable loop element (22) in a particular configuration to maintain engagement with the upper arm (21) of a person (5)(or other part of the person depending upon the application). While the embodiment of the securement element (26) shown by FIGS. 11 and 12 provide mateable hook and loop elements the invention is not so limited and any manner of securement element (26) can be utilized which secures the configuration of the adjustable loop element (22) to the upper arm (21) of a person (5)(or other part of the part of the person depending upon the application) such as mateable parts of a mechanical fasteners including clasps, snaps, or the like could utilized.

As can be easily understood from the foregoing, the basic concepts of the present invention may be embodied in a variety of ways. The invention involves numerous and varied inventive tethers and methods of using such inventive tethers.

As such, the particular embodiments or elements of the invention disclosed by the description or shown in the figures or tables accompanying this application are not intended to be limiting, but rather exemplary of the numerous and varied embodiments generically encompassed by the invention or equivalents encompassed with respect to any particular element thereof. In addition, the specific description of a single embodiment or element of the invention may not explicitly describe all embodiments or elements possible; many alternatives are implicitly disclosed by the description and figures.

It should be understood that each element of an apparatus or each step of a method may be described by an apparatus term or method term. Such terms can be substituted where desired to make explicit the implicitly broad coverage to which this invention is entitled. As but one example, it should be understood that all steps of a method may be disclosed as an action, a means for taking that action, or as an element which causes that action. Similarly, each element of an apparatus may be disclosed as the physical element or the action which that physical element facilitates. As but one example, the disclosure of a "fastener" should be understood to encompass disclosure of the act of "fastening"—whether explicitly discussed or not—and, conversely, were there effectively disclosure of the act of "fastening", such a disclosure should be understood to encompass disclosure of a "fastener" and even a "means for fastening." Such alternative terms for each element or step are to be understood to be explicitly included in the description.

In addition, as to each term used it should be understood that unless its utilization in this application is inconsistent with such interpretation, common dictionary definitions should be understood to included in the description for each term as contained in the Random House Webster's Unabridged Dictionary, second edition, each definition hereby incorporated by reference.

Thus, the applicant(s) should be understood to claim at least: i) each of the compositions or extracts herein disclosed and described, ii) the related methods disclosed and described, iii) similar, equivalent, and even implicit variations of each of these devices and methods, iv) those alternative embodiments which accomplish each of the functions shown, disclosed, or described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) methods and apparatuses substantially as described hereinbefore and with reference to any of the accompanying examples, x) the various combinations and permutations of each of the previous elements disclosed.

The background section of this patent application provides a statement of the field of endeavor to which the invention pertains. This section may also incorporate or contain paraphrasing of certain United States patents, patent applications, publications, or subject matter of the claimed invention useful in relating information, problems, or concerns about the state of technology to which the invention is drawn toward. It is not intended that any United States patent, patent application, publication, statement or other information cited or incorporated herein be interpreted, construed or deemed to be admitted as prior art with respect to the invention.

The claims set forth in this specification, if any, are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent application or continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

The claims set forth below are intended to describe the metes and bounds of a limited number of the preferred embodiments of the invention and are not to be construed as the broadest embodiment of the invention or a complete listing of embodiments of the invention that may be claimed. The applicant does not waive any right to develop further claims based upon the description set forth above as a part of any continuation, division, or continuation-in-part, or similar application.

The invention claimed is:

1. A tether, comprising:

a. an elastic member having an unstretched length disposed between a first end and a second end which includes a first portion of said unstretched length which has a first amount of elastic resistance and a second portion of said unstretched length which has a second amount of elastic resistance, and wherein said first portion of said unstretched length provides less elastic resistance than said second portion of said unstretched length;

b. a flexible member disposed between a first end and a second end having less elasticity than said elastic member which limits stretched length of said elastic member; and c. a first fastener and a second fastener each coupled to a corresponding one of said first end and said second end of said elastic member and to a corresponding one of said first end and said second end of said flexible member.

2. A tether as described in claim 1, wherein said first portion of said unstretched length and said second portion of said unstretched length comprise a first discrete elastic element having said first amount of elastic resistance joined to a second discrete elastic element having said second amount of elastic resistance.

3. A tether as described in claim 2, wherein said first portion of said unstretched length and said second portion of said unstretched length comprises a first discrete elastic element having said first amount of elastic resistance joined to at least two elastic elements having a combined elastic resistance which comprises said second amount of elastic resistance.

4. A tether as described in claim 3, wherein said at least two elastic elements having said combined elastic resistance comprises a plurality of layers of said first elastic element.

5. A tether as described in claim 4, wherein said plurality of layers of said first elastic element comprise a folded portion of said first elastic element.

6. A tether as described in claim 5, wherein said folded portion of said first elastic element comprises three layers of said first elastic element.

7. A tether as described in claim 6, wherein said first elastic element comprises an elastic strap.

8. A tether as described in claim 1, wherein said first portion of said unstretched length and said second portion of said unstretched length comprises said unstretched length of said elastic member having lesser elastic resistance proximate to said first end and greater elastic resistance proximate to said second end.

9. A tether as described in claim 1, wherein said first end and said second end of said flexible member have correspondingly fixed engagement proximate to said first end and said second end of said elastic member.

10. A tether as described in claim 1, wherein each of said first fastener and said second fastener provides a base coupled to a corresponding one of said first end and said second end of said elastic member and a clasp coupled to said base.

11. A tether as described in claim 1, wherein said first fastener comprises a ring element coupled to said first end of said elastic member and said flexible member, and wherein said second fastener comprises a tool containment element coupled to said second end of said elastic member and said flexible member.

12. A method for producing a tether, comprising the steps of:

a. providing an elastic member having an unstretched length disposed between a first end and a second end including:
   i. providing a first portion of said unstretched length having a first amount of elastic resistance;
   ii. providing a second portion of said unstretched length having a second amount of elastic resistance, wherein said first portion of said unstretched length provides less elastic resistance than said second portion of said unstretched length;

b. coupling a first fastener to said first end of said elastic member; and c. coupling a second fastener to said second end of said elastic member.

13. A method for producing a tether as described in claim 12, wherein said step of providing a first portion of said unstretched length having a first amount of elastic resistance comprises the step of providing a first discrete elastic element having a first amount of resistance.

14. A method for producing a tether as described in claim 13, wherein said step of providing a second portion of said unstretched length having a second amount of elastic resistance comprises the step of providing a second discrete elastic element having said second amount of resistance, and wherein said first discrete elastic element having said first amount of elastic resistance connects to said second discrete elastic element having said second amount of elastic resistance to form said elastic member.

15. A method for producing a tether as described in claim 12, wherein said step of providing a first portion of said unstretched length having a first amount of elastic resistance comprises the step of providing an elastic element having an unstretched length disposed between a first end and a second end, and wherein said step of providing a second portion of said unstretched length having a second amount of elastic resistance comprises the step of folding a portion of said unstretched length of said elastic element to generate at least two layers.

16. A method for producing a tether as described in claim 15, wherein said step of coupling a first fastener to said first end of said elastic member comprises the step of coupling a base to said first end of said elastic member and a clasp coupled to said base.

17. A method for producing a tether as described in claim 16, wherein said step of coupling a second fastener to said second end of said elastic member comprises the step of coupling a tool containment element to said second end of said elastic member and said flexible member.

18. A method for producing a tether as described in claim 12, further comprising the step of providing a flexible member disposed between said first end and said second end having less elasticity than said elastic member which limits stretched length of said elastic member.

19. A method for producing a tether as described in claim 18, where said step of providing a flexible member disposed between said first end and said second end having less elasticity than said elastic member which limits stretched length of said elastic member further comprises locating said elastic member having an unstretched length disposed between a first end and a second end within said flexible member.

* * * * *